US005728284A

United States Patent [19]

Oyama

[11] Patent Number: 5,728,284

[45] Date of Patent: Mar. 17, 1998

[54] PROCESS FOR MANUFACTURING A POROUS ELECTROFORMED SHELL

[75] Inventor: Kanji Oyama, Mizunami, Japan

[73] Assignee: KTX Co., Ltd., Aichi-ken, Japan

[21] Appl. No.: 710,213

[22] Filed: Sep. 13, 1996

[30] Foreign Application Priority Data

Jan. 9, 1996 [JP] Japan ..... 8-019340
Jun. 11, 1996 [JP] Japan ..... 8-173040

[51] Int. Cl.[6] ..... C25D 1/10

[52] U.S. Cl. ..... 205/70; 205/75; 205/170; 219/121.7

[58] Field of Search ..... 205/67, 70, 71, 205/75, 170; 219/121.7

[56] References Cited

U.S. PATENT DOCUMENTS 5,119,550 6/1992 Baughman et al. ..... 205/75

FOREIGN PATENT DOCUMENTS 218331 9/1988 Japan .
2-14435 4/1990 Japan .
112887 5/1993 Japan .
5-171485 7/1993 Japan .
5-195279 8/1993 Japan .

*Primary Examiner*—Kathryn L. Gorgos
*Assistant Examiner*—Kishor Mayekar
*Attorney, Agent, or Firm*—Cushman Darby & Cushman Intellectual Property Group of Pillsbury Madison & Sutro LLP

[57] ABSTRACT

A poreless first layer is electroformed on the conductive surface of a mandrel in an electroforming solution containing a substantial amount of a surface active agent. After the mandrel and the first layer are lifted from the solution, small straight pores each having an approximately equal diameter along a length thereof are formed through the first layer defining the front side of a porous electroformed shell. A second layer is deposited on the back side of the first layer in an electroforming solution containing less than the substantial amount of a surface active agent to form the back side of the shell, while undeposited hollow portions are formed in alignment with the straight pores in the first layer in initial formation of the second layer, the hollow portions enlarging to form diametrically enlarged pores through the second layer, the enlarged pores having a diameter which becomes larger toward a surface of the second layer opposite from the first layer.

15 Claims, 6 Drawing Sheets

PROCESS FOR MANUFACTURING A POROUS ELECTROFORMED SHELL

The priority applications, Japanese Patent Applications NO. 8-19340, filed in Japan on Jan. 9, 1996, and No. 8-173040, filed in Japan on Jun. 11, 1996, are hereby incorporated into the present specification by reference.

BACKGROUND OF THE INVENTION

1. Field of the Invention:

This invention relates to a process for manufacturing a porous electroformed shell which can be used as the main body of a mold for any of a variety of molding operations, such as vacuum or vacuum pressure forming, blow molding, stamping, roll forming, injection or reactive injection molding, or compression molding, or as a filter, or for a variety of other purposes.

2. Description of Related Art:

Most of the porous electroformed shells used to be manufactured by a process comprising preparing a poreless shell by a common electroforming method, and forming pores through the wall of the shell by laser work. The pores formed by laser work, however, had a substantially equal diameter along their length, and had, therefore, the drawbacks of presenting so large a resistance to the flow of air therethrough as to disable a strong suction, or of getting blocked easily.

The inventor of this invention, therefore, developed a new process for manufacturing a porous electroformed shell (or mold) which comprises electroforming a mold shell on the surface of a mandrel having an electrically conductive layer having a multiplicity of very small non-conductive portions on its surface, so that very small undeposited portions may be formed on the non-conductive portions in the beginning of the electroforming operation, and may grow with the progress of the operation to eventually form a multiplicity of pores through the wall of the shell, as disclosed in Japanese Patent Publication No. 2-14434.

This process made it possible to form pores easily through any portion of an electroformed shell simultaneously with its electroforming without using any particularly expensive equipment. The pores had a small diameter on the front side of the shell and an enlarged diameter toward its back side, and therefore, did not leave any mark on a molded product, presented a sufficiently small resistance to the flow of air therethrough to ensure a strong suction, and did not easily get blocked. These were ideal results expected from the use of a porous electroformed shell. The number of pores could be altered from one portion of the shell to another if the non-conductive portions of the conductive layer were appropriately changed.

Even the porous electroformed shell made by the new process has, however, been found to have the drawback that its pores gradually have an enlarged diameter on its front side. While the pores certainly have a small diameter on the front side of the shell in the beginning, those portions of the pores along which they have a small diameter have so small a length that they begin to have an enlarged diameter immediately inwardly of the shell surface. If a porous electroformed shell having a mirror surface on its front side is used for a mold, and has its surface polished to maintain its mirror finish, the wear of the shell surface results in the disappearance of the pore portions having a small diameter and the exposure of the pore portions having an enlarged diameter in the shell surface. If the use of any such shell is continued, the pores are likely to leave marks on a molded product. If any such shell is used as a filter, it is likely to fail to function as a proper filter.

Japanese Patent Application Laid-Open Specification Nos. 5-171485 and 5-195279 disclose a process which comprises forming a first electroformed layer having no pore, forming a porous second electroformed layer on its back side, and forming pores in the first electroformed layer. This process, however, differs from this invention, in the step of forming pores in the first electroformed layer: The pores in the first electroformed layer do not take any part in the formation of pores in the second electroformed layer.

SUMMARY OF THE INVENTION

It is an object of this invention to provide a process for manufacturing a porous electroformed shell having a pore diameter which can be kept satisfactorily small on the front side of the shell despite the abrasion of its surface or even after its prolonged use, and is enlarged toward the back side of the shell, so that its pores may not present any undesirably large resistance to the flow of air therethrough, or may not undesirably be blocked.

This object is attained by a process which comprises the steps of preparing a mandrel having an electrically conductive surface; forming a poreless first electroformed layer on the conductive surface of the mandrel in an electroforming solution containing a substantial amount of a surface active agent to form the front side of a shell; removing the mandrel and the first electroformed layer from the solution, and forming through the first electroformed layer small straight pores each having an approximately equal diameter along a length thereof; and forming a second electroformed layer on a back side of the first electroformed layer in an electroforming solution containing less than the substantial amount of the surface active agent to form a back side of the shell, while undeposited hollow portions are formed in alignment with the straight pores in initial formation of the second electroformed layer, the hollow portions enlarging to form diametrically enlarged pores through the second electroformed layer, the enlarged pores having a diameter which becomes larger toward a surface of the second electroformed layer, opposite from the first electroformed layer.

The mandrel may be prepared by any adequate method from an electrically non-conductive material, such as a synthetic resin, solid wax, plaster, wood, a ceramic material, cloth or yarn, or a conductive material, such as a metal or graphite. If the mandrel is of a non-conductive material, its conductive surface may be formed by a conductive film formed on the mandrel surface by e.g. the application of a paste of a conductive powder, such as of silver, copper or aluminum, a silver-mirror reaction, or electroless plating. If the mandrel is of a conductive material, no such additional work is required to form its conductive surface.

The electroforming solution containing a substantial (or less than a substantial) amount of a surface active agent is a solution containing (or not containing) a surface active agent, such as sodium lauryl sulfate, in an amount in which it substantially exhibits a proper surface-active action to restrain the formation of pinholes. Therefore, a solution containing a surface active agent in such a small amount that it is hardly effective for restraining the formation of pinholes is a solution containing less than a substantial amount of a surface active agent. There is no particular limitation to the surface active agent which can be used for the purpose of this invention. There is no particular limitation, either, to the metal which can be used in the electroforming solution, though nickel or a nickel-cobalt alloy can be mentioned by way of example.

The first electroformed layer on the front side of the shell has a thickness not specifically limited, but preferably in the range of 0.1 to 1.0 mm, since too thin a layer tends to be easily worn away, while too thick a layer tends to have its pores blocked easily. The second electroformed layer on the back side of the shell has a thickness not specifically limited, but preferably in the range of 0.5 to 5.0 mm, since too thin a layer gives a shell of low strength, while too thick a layer calls for an unduly long time for its formation.

The straight pores on the front side of the shell have a diameter not specifically limited, but preferably in the range of 5 to 1000 μm in most of the cases, as their diameter depends on the purpose for which the shell will be used. If the shell is used as the main body of a mold, its straight pores preferably have a diameter of 5 to 200 μm.

The straight pores may have a diameter varying from one portion to another on the front side of the shell. For example, they may have a diameter of 50 μm in one region and a diameter of 150 μm in another. Each pore, of course, has a diameter which is substantially equal along its length.

The number of the straight pores is not specifically limited, as it depends on the purpose for which the shell will be used, but in most of the cases, it is preferably in the range of 1 to 10,000, and more preferably in the range of 10 to 1,000, per unit area of 100 $cm^2$ on the front side of the shell.

The number of the straight pores may vary from one region to another. For example, the layer may have 50 pores per unit area of 100 $cm^2$ in one region, and 400 pores in another. It is also possible that the pores may be formed only in a limited portion or portions of the layer, while no pore is formed in the rest thereof.

The small straight pores in the first electroformed layer can be formed by, for example, employing a beam of high energy, such as a laser beam, or a beam of electrons or ions, or utilizing electric discharge, or by drilling. It is known that the use of a laser beam is likely to result in the formation of a tapered pore having a wall inclined at an angle of, say, 1 to 20 degrees to its longitudinal axis, depending on the angle at which radiation is applied. In the context of this invention, such a tapered pore is included in the small straight pores each having a diameter which is substantially equal along a length thereof.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DESCRIPTION OF THE PREFERRED EMBODIMENTS

Description will now be made of a process embodying this invention with reference to FIGS. 1 to 10.

Figure 1:
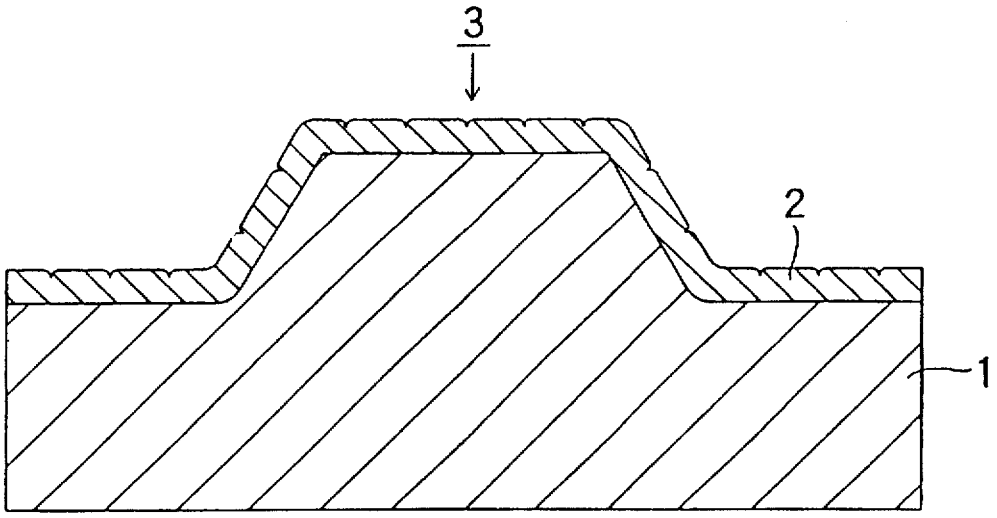
FIG. 1 is a cross-sectional view of a master model employed in a process embodying this invention.

(1) A model 1 having the same contour with the desired molded product of a synthetic resin is formed from wood, a synthetic resin, plaster, wax, or any other adequate material, and a pattern forming material 2 is bonded to the surface of the model 1 to form a master model 3, as shown in FIG. 1. Cowhide having a fine original embossed pattern is used as the pattern forming material 2, though it may alternatively be possible to use, fox example, suede or cloth.

Figure 2:
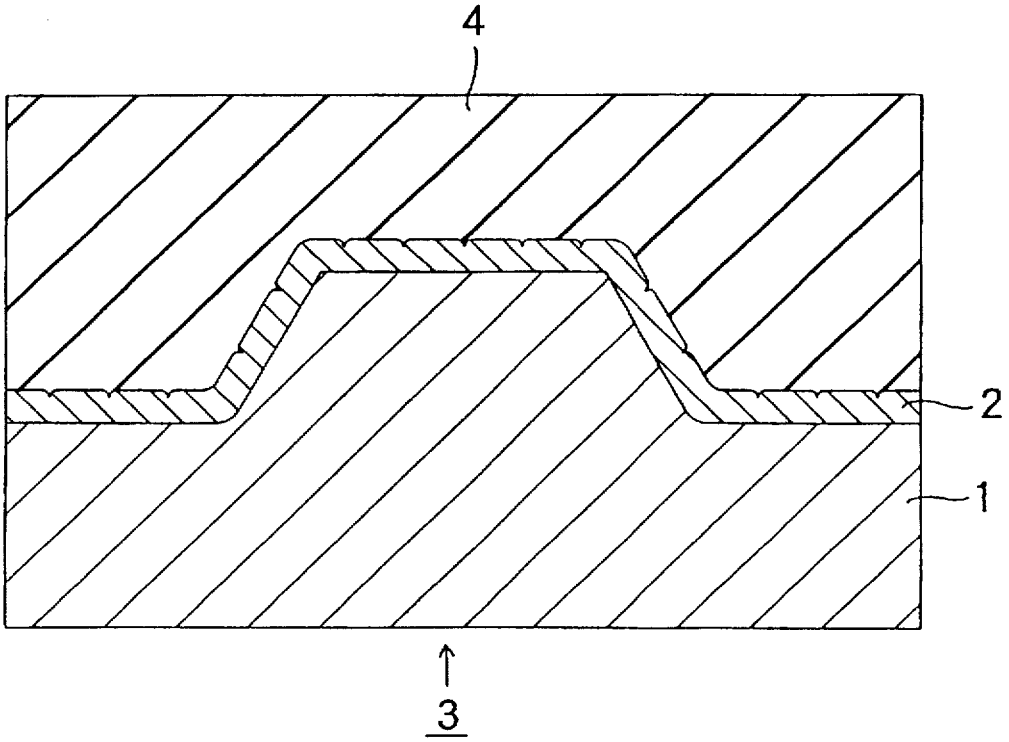
FIG. 2 is a cross-sectional view of the master model and an intermediate mold formed from silicone rubber.

(2) Silicone rubber, or another lowly adhering material is poured on the surface of the master model 3 by a device not shown, and is hardened to form an intermediate mold 4 having a reverse embossed pattern formed by the transfer of the original embossed pattern from the pattern forming material 2, as shown in FIG. 2. The intermediate mold 4 is separated from the master model 3.

Figure 3:
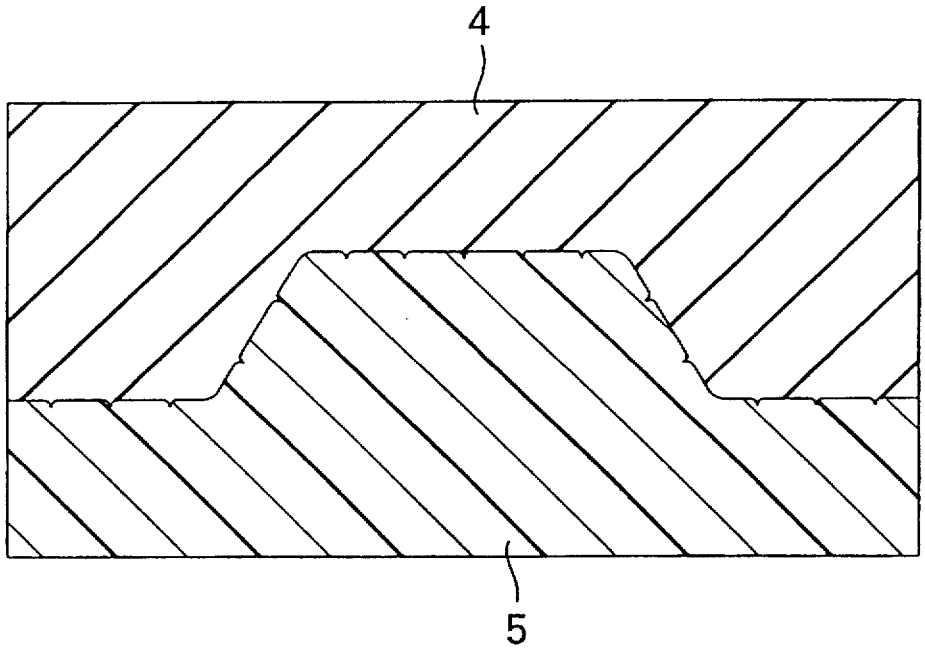
FIG. 3 is a cross-sectional view of the intermediate mold and a mandrel formed from an epoxy resin.

(3) An epoxy resin, or another reaction-curing material is poured on the surface of the intermediate mold 4, and is cured to form a mandrel 5 having an embossed pattern formed by the transfer of the reverse embossed pattern from the intermediate mold 4, as shown in FIG. 3. The mandrel 5 is separated from the intermediate mold 4, and has its surface polished with e.g. a solvent, and grinding material which remove any stain, or film of oil from its surface and coarsen it, so that a conductive film 6 may fit it closely. Then, the solvent and grinding material are removed by washing from the mandrel 5, and air is blown against it to dry it quickly.

Figure 4:
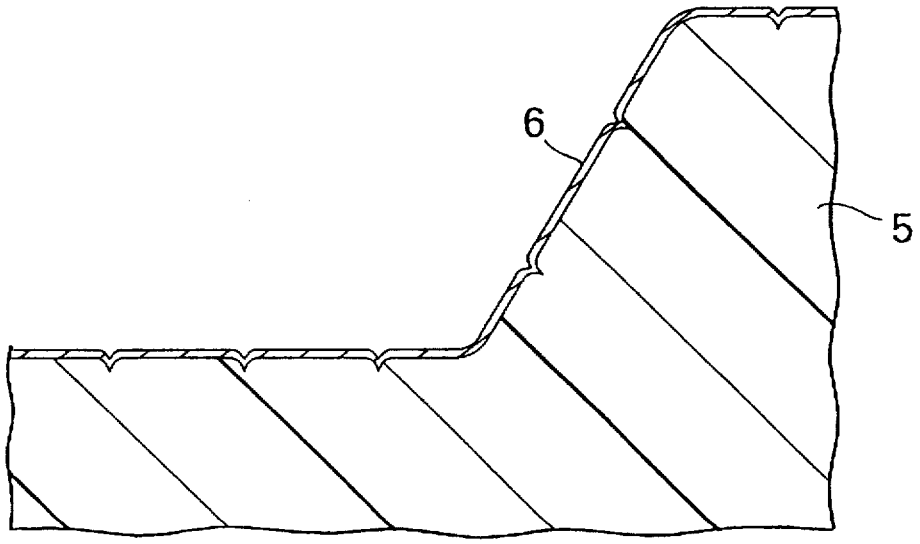
FIG. 4 is an enlarged cross-sectional view of a part of the mandrel having a conductive film formed thereon.

(4) A thin conductive film 6 is formed on the surface of the mandrel 5 by a method employing e.g. a silver-mirror reaction to give it an electrically conductive surface, as shown in FIG. 4. The silver-mirror reaction is a known method of coating the surface of an object with a layer of silver formed by reduction. The thickness of the conductive film 6 is not specifically limited, but is preferably in the range of 5 to 30 μm. Too thin a film fails to provide any satisfactory level of conductivity, while too thick a film deforms the embossed pattern.

Figure 5:
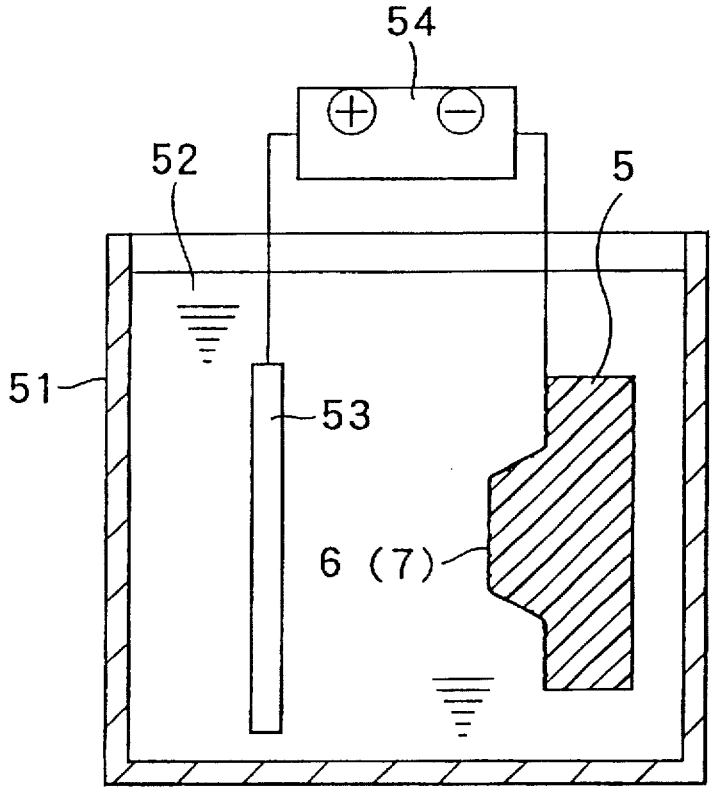
FIG. 5 is a schematic diagram showing the step of forming a first electroformed layer on the conductive film.
Figure 6:
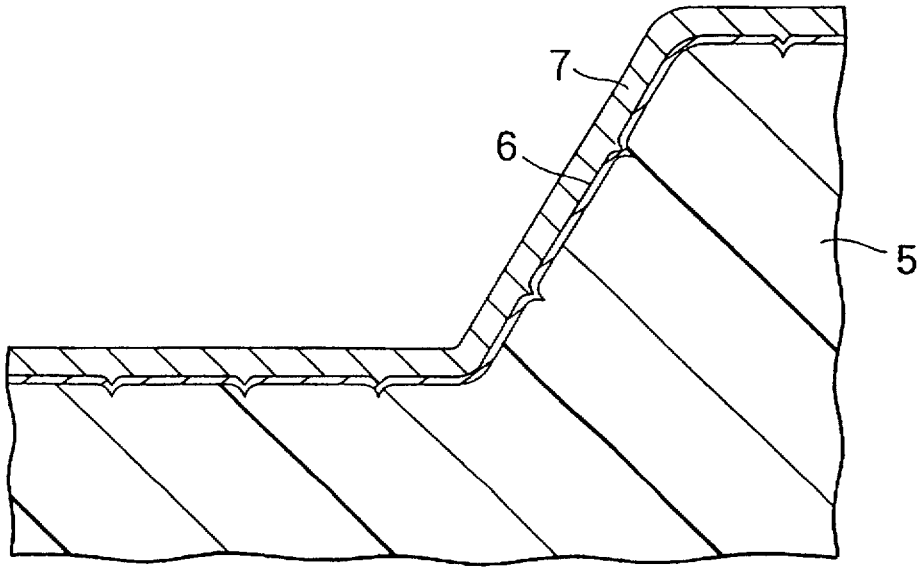
FIG. 6 is an enlarged cross-sectional view of a part of the mandrel and the first electroformed layer formed thereon to form the front side of an electroformed shell.

(5) A poreless first electroformed layer 7 defining the front side of an electroformed shell is formed on the conductive film 6 in an electroforming solution containing a substantial amount (0.1–1.0 g/liter) of a surface active agent, as shown in FIGS. 5 and 6. A tank 51 holds an electroforming solution 52 containing a substantial amount of a surface active agent, as shown in FIG. 5. The electroforming solution 52 is an aqueous solution having, for example, the composition as shown in Table 1 below. Sodium lauryl sulfate is used as the surface active agent.

TABLE 1

| Composition | Content for water |
|---|---|
| Nickel sulfamate | 300–450 g/liter |
| Nickel chloride | 0–10 g /liter |
| Boric acid | 30–45 g /liter |
| Sodium lauryl sulfate | 0.1–1.0 g /liter |

Sulfamic acid is added into the electroforming solution 52 to maintain its pH in the range of 3.0 to 4.5. The solution 52 is held at a temperature of 30° C. to 50° C. The mandrel 5 having the conductive film 6 is dipped as the cathode in the electroforming solution 52, and a nickel electrode 53 employed as an electroforming metal is dipped as the anode. A power-source unit 54 for applying a DC voltage between the nickel electrode 53 and the conductive film 6 is capable of performing constant voltage or current control selectively. An electric current is supplied by the power- source unit 54 so as to flow between the nickel electrode 53 and the conductive film 6 at a cathode current density of 0.5 to 3.0 A/dm$^2$ to deposit nickel on the conductive film 6 to gradually form a poreless first electroformed layer 7 defining the front side of an electroformed shell, as shown in FIG. 6. The supply of the current is discontinued when the layer 7 has gained a thickness of, say, about 0.6 mm.

Figure 7:
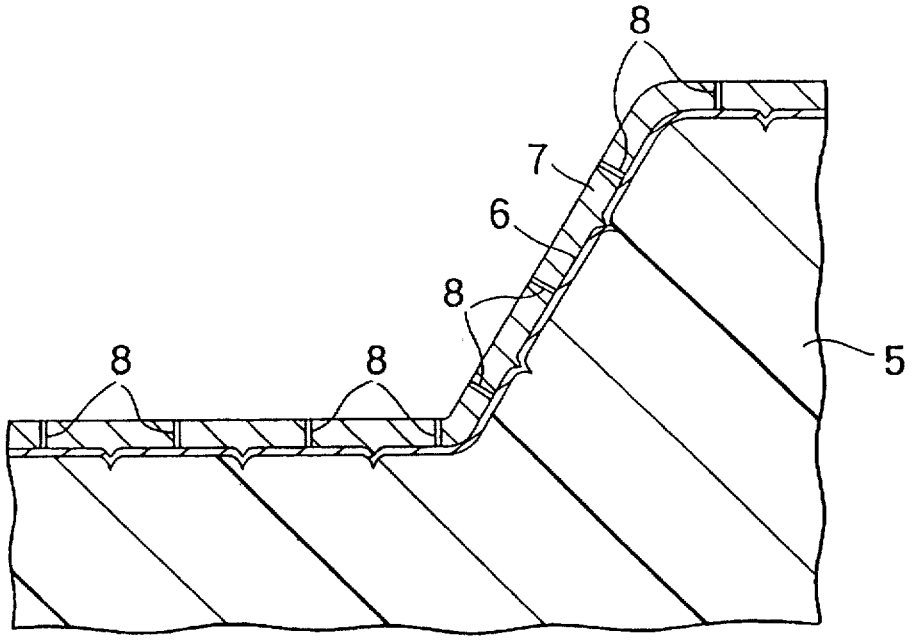
FIG. 7 is an enlarged cross-sectional view of a part of the mandrel and the first electroformed layer having very small straight pores formed therethrough.

(6) The mandrel 5 and the first electroformed layer 7 formed thereon are lifted from the electroforming solution 52 and very small straight pores 8 each having a substantially equal diameter along a length thereof are formed by laser work through that portion of the layer 7 which calls for those pores, as shown in FIG. 7. The pores 8 have a diameter of, say, 50 to 150 μm which differs from one region of the layer 7 to another. The number of the pores 8 per unit area also differs from one region to another and is in the range of, say, 10 to 1,000 per 100 cm$^2$ of the layer 7.

Figure 8:
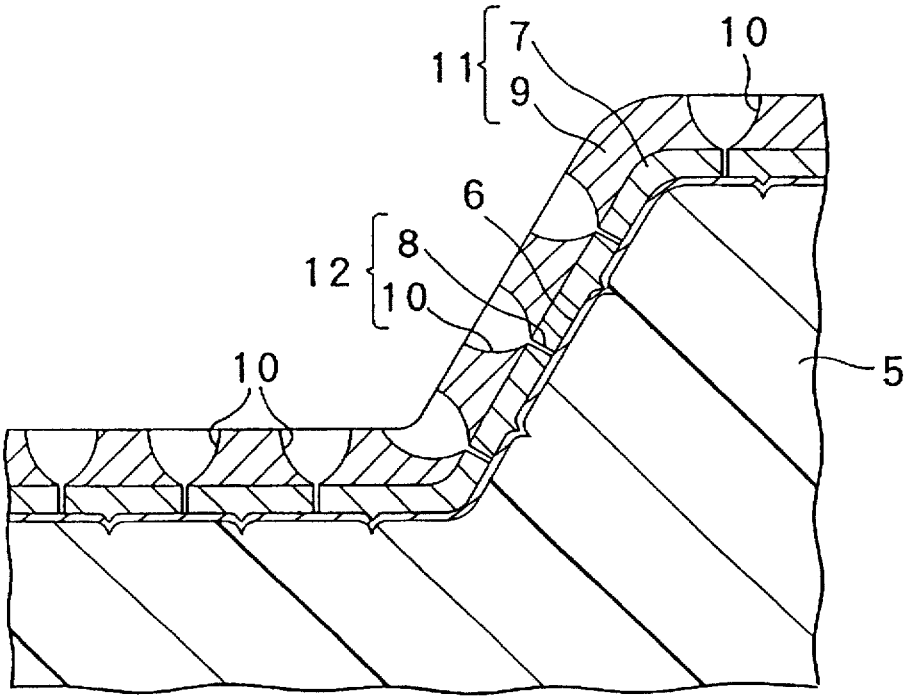
FIG. 8 is an enlarged cross-sectional view of a part of the mandrel, the first electroformed layer and a second electroformed layer formed thereon to form the back side of the shell.

(7) A second electroformed layer 9 defining the back side of the shell is formed on the first electroformed layer 7 in an electroforming solution containing less than the substantial amount (less than 0.1 g/liter) of the surface active agent (as defined above), while diametrically enlarged pores 10 are so formed in the layer 9 that each pore 10 may have a diameter which becomes larger toward the opposite surface of the layer 9 from the first electroformed layer 7, as shown in FIGS. 5 and 8. The layer 9 is formed by employing an apparatus which is substantially identical to that employed for forming the layer 7, as shown in FIG. 5, but the electroforming solution 52 is of a different composition as shown by way of example in Table 2 below.

TABLE 2

| Composition | Content for water |
|---|---|
| Nickel sulfamate | 300–450 g/liter |
| Nickel chloride | 0–10 g/liter |
| Boric acid | 30–45 g/liter |
| Sodium lauryl sulfate | less than 0.1 g/liter |

The electroforming solution 52 has its pH and temperature maintained in the ranges as stated above in connection with the step of forming the first electroformed layer 7. An electric current is supplied by the power-source unit 54 so as to flow between the nickel electrode 53 and the first electroformed layer 7 at a cathode current density of 0.5 to 3.0 A/dm$^2$, whereby nickel is gradually deposited on the layer 7 to form the second electroformed layer 9, as shown in FIG. 8. The nickel deposited on the layer 7 does not cover the pores 8, but leaves undeposited hollow portions which are coaxial with the pores 8, and substantially of the same diameter therewith in the beginning. The electroforming solution 52 does not restrain the formation of pinholes, since it contains less than a substantial amount of surface active agent. The undeposited hollow portions, therefore, are not closed, but grow in diameter with the progress of the electroforming operation to eventually form the diametrically enlarged pores 10 through the second electroformed layer 9, as shown in FIG. 8. The supply of the current is discontinued when the layer 9 has gained a thickness of, say, about 3 mm. The pores 10 have a diameter of 1 to 6 mm on the outer surface of the layer 9.

The first and second electroformed layers 7 and 9 form a porous electroformed shell 11 having through pores 12 each formed by one of the pores 8 in the layer 7 and the corresponding pore 10 in the layer 9, as shown in FIG. 8.

Figure 9:
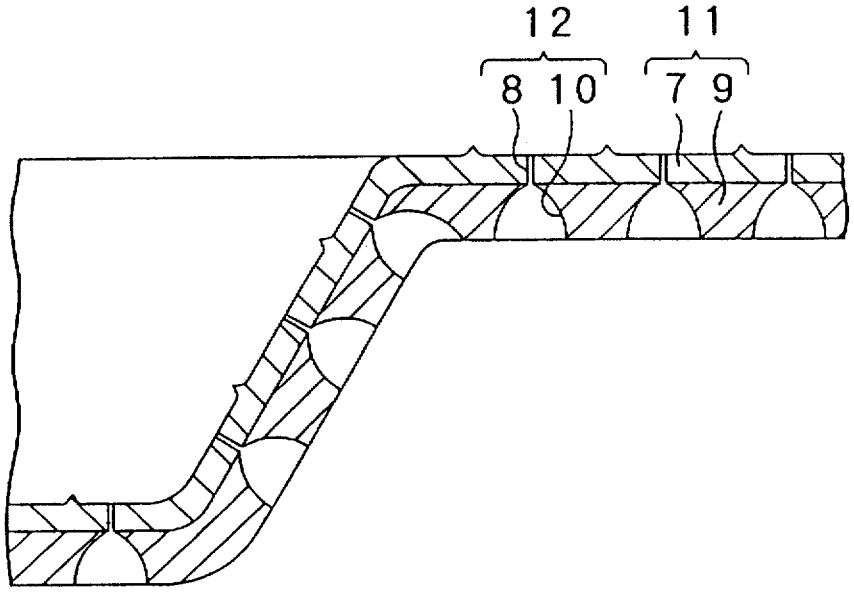
FIG. 9 is an enlarged cross-sectional view of a part of the porous electroformed shell manufactured as shown in FIG. 8, and separated from the mandrel.
Figure 10:
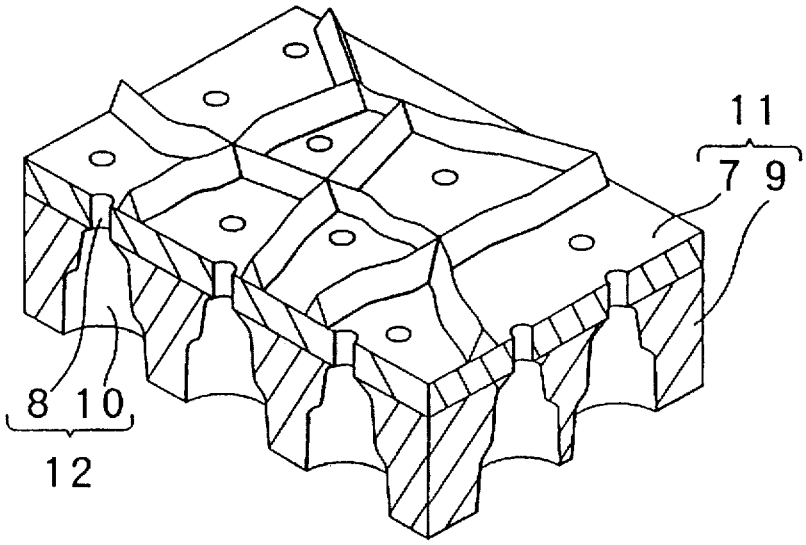
FIG. 10 is an enlarged perspective view of a part of the shell shown in FIG. 9.

(8) The mandrel 5 and the porous electroformed shell 11 are lifted from the electroforming solution 52, and the shell 11 is separated from the mandrel 5. If the conductive film 6, or any part thereof adheres to the shell 11, it is removed from the shell 11. The shell 11 has on the surface of its first electroformed layer 7 an embossed pattern formed by the reversal and transfer of the embossed pattern on the mandrel 5, as shown in FIGS. 9 and 10. The number of the through pores 12 is substantially equal to that of the straight pores 8 in the layer 7, as the diametrically enlarged pores 10 are so formed as to extend from substantially all of the pores 8. The pores 12 have a varying diameter which is equal to the diameter of the straight pores 8, or in the range of 10 to 200 μm on the front side of the shell 11, and is in the range of 1 to 6 mm on its back side.

Figure 11:
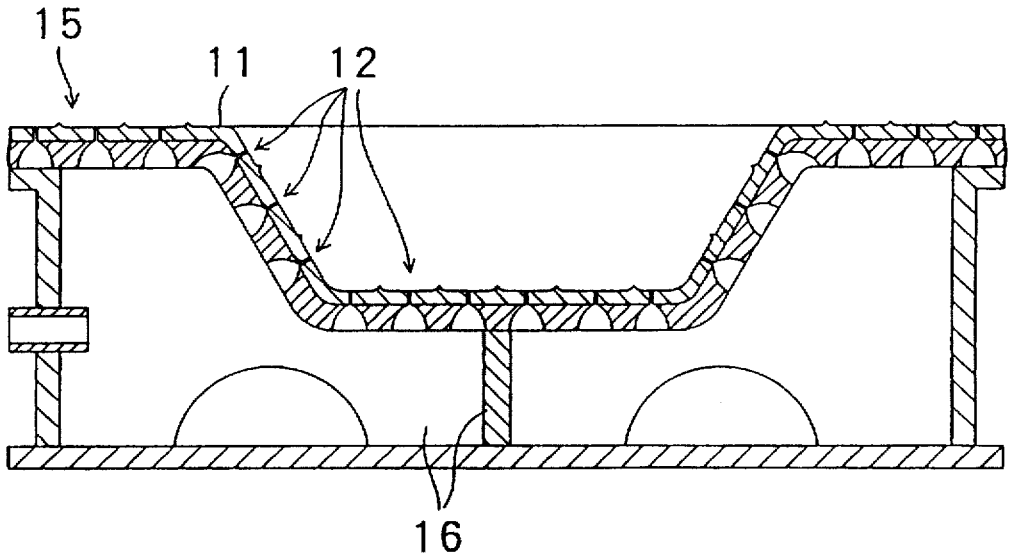
FIG. 11 is a cross-sectional view of a blow mold assembled by employing the shell as show in FIGS. 9 and 10.

The porous electroformed shell 11 manufactured as described above can, for example, be used as the main body of a blow mold 15, as shown in FIG. 11. The shell 11 is reinforced on its back side by a supporting plate 16 and other backup members not shown, such as stud bolts, a granular filler and a metal block shaped by electric discharge. The through pores 12 of the shell 11 serve as ventholes for the mold 15 and make it possible to draw air out of the clearance between the shell 11 and a parison formed therein, though not shown, and transfer the embossed pattern clearly from the shell 11 to a blow molded product.

The pores 12 are so small in diameter on the front side of the shell 11 as not to leave any marks on the molded product, and are so large on its back side as not to present any undesirably large resistance to the flow of the air drawn out therethrough, and as not to be easily blocked. If a vacuum pump not shown is employed to create a negative pressure in the space facing the back side of the shell 11, it is possible to ensure the still more effective suction of air through the pores 12 for the attraction of the parison to the shell 11 and thereby the still clearer transfer of the embossed pattern.

As the straight pore 8 defining the diametrically smallest portion of each through pore 12 on the front side of the shell 11 has a length of about 0.6 mm equal to the thickness of the layer 7 on the front side of the shell 11, there is no possibility of any diametrically enlarged pore 10 being exposed on the front side of the shell 11, even if the layer 7 may have its surface worn to some extent or other as a result of the prolonged use of the shell 11 for a blow mold, or the like, or its polishing for surface cleaning.

Figure 12:
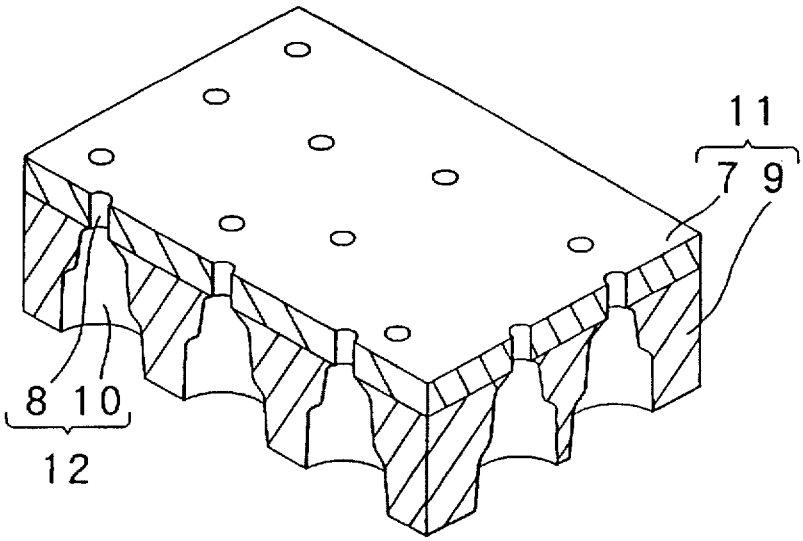
FIG. 12 is an enlarged perspective view of a part of a modified form of porous electroformed shell having a mirror surface.

While the invention has been described by way of its preferred embodiment, it is to be understood that variations or modifications may easily be made without departing from the scope and spirit of this invention. A few examples of variations or modifications are mentioned below:

(1) A mandrel formed from a metal plate and having a mirror surface is used to make a porous electroformed shell 11 having a mirror surface, and not having any embossed pattern, as shown in FIG. 12. The reference numerals appearing in FIG. 12 are as explained above with reference to the other drawings.

(2) A mandrel formed from a metal bar, or tube is used to make a porous electroformed shell having a cylindrical shape.

(3) The porous electroformed shell 11 can be used not only for a blow mold, but also for a mold for vacuum or vacuum pressure forming, stamping, roll forming, injection or reactive injection molding, or compression molding, or as a filter, or for other purposes.

As many apparently widely different embodiments of this invention may be made without departing from the spirit and scope thereof, it is to be understood that the invention is not limited to the specific embodiments thereof except as defined in the appended claims.

What is claimed is:

1. A process for manufacturing a porous electroformed shell which comprises the steps of:

preparing a mandrel having an electrically conductive surface;

forming a poreless first electroformed layer on said conductive surface in an electroforming solution containing a substantial amount of a first surface active agent sufficient to restrain formation of pinholes in said layer to form a front side of a shell, removing said mandrel and said layer from said solution, and forming, through said layer, straight pores, each having an approximately equal diameter along a length thereof; and forming a second electroformed layer on a back side of said first layer, in an electroforming solution containing less than said substantial amount of a second surface active agent to form a back side of the shell, such that said second electroformed layer forms with hollow portions therein which are aligned with said straight pores on the first layer, said hollow portions enlarging diametrically during the forming of said second layer to form diametrically enlarged pores through said second layer, said enlarged pores having a diameter which becomes larger toward a surface of said second layer opposite from first layer.

2. A process as set forth in claim 1, wherein said first layer has a thickness of 0.1 to 1.0 mm.

3. A process as set forth in claim 1, wherein said second layer has a thickness of 0.5 to 5.0 mm.

4. A process as set forth in claim 1, wherein said straight pores are formed such that said diameter of said straight pores is from 5 to 1,000 μm.

5. A process as set forth in claim 1, wherein said shell is a main body of a mold, and said straight pores are formed such that said diameter of said straight pores is from 5 to 200 μm.

6. A process as set forth in claim 1, wherein said straight pores are formed such that said diameter of said straight pores differs from one portion of said first layer to another portion thereof.

7. A process as set forth in claim 1, wherein said straight pores are formed such that a unit area of said first layer measuring 100 $cm^2$ contains 1 to 10,000 pores.

8. A process as set forth in claim 1, wherein said straight pores are formed such that a unit area of said first layer measuring 100 $cm^2$ contains 10 to 1,000 pores.

9. A process as set forth in claim 1, wherein said straight pores are formed such that one portion of said first layer has a different number of pores from another portion thereof.

10. A process as set forth in claim 1, wherein said straight pores are formed by a method employing a beam of high energy.

11. A process as set forth in claim 10, wherein said beam is of laser radiation.

12. A process as set forth in claim 10, wherein said beam is of electrons.

13. A process as set forth in claim 10, wherein said beam is of ions.

14. A process as set forth in claim 1, wherein said straight pores are formed by a method employing electric discharge.

15. A process as set forth in claim 1, wherein said straight pores are formed by drilling.

* * * * *